US006974510B2

(12) United States Patent
Watson

(10) Patent No.: US 6,974,510 B2
(45) Date of Patent: Dec. 13, 2005

(54) ALUMINUM BASE ALLOYS

(75) Inventor: Thomas J. Watson, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 3 days.

(21) Appl. No.: 10/376,143

(22) Filed: Feb. 28, 2003

(65) Prior Publication Data

US 2004/0170522 A1 Sep. 2, 2004

(51) Int. Cl.[7] ..... C22C 21/00
(52) U.S. Cl. ..... 148/437; 420/550; 420/551
(58) Field of Search ..... 148/437; 420/550, 420/551

(56) References Cited

U.S. PATENT DOCUMENTS 5,053,085 A * 10/1991 Masumoto et al. ..... 148/403
5,256,215 A 10/1993 Horimura
5,318,641 A * 6/1994 Masumoto et al. ..... 148/403
5,532,069 A * 7/1996 Masumoto et al. ..... 428/552

FOREIGN PATENT DOCUMENTS

EP 0 534 470 A1 3/1993
EP 0 662 524 A1 7/1995

OTHER PUBLICATIONS

"Metals Handbook: Desk Edition" Davis, J.R., ASM International, 1998, p 30.*

A.L. Vasiliev et al., "Crystallization of Glassy Powder from Aluminum–Rare Earth–Transition Metal Alloys", Materials Research Society Symposium Proceedings, (2003), vol. 754, pp. 399–404.

* cited by examiner

*Primary Examiner*—George Wyszomierski
*Assistant Examiner*—Janelle Morillo
(74) *Attorney, Agent, or Firm*—Bachman & LaPointe, P.C.

(57) ABSTRACT

High strength, high ductility aluminum base alloys containing from 3 to 18.5 atomic percent nickel and 3 to 14.0 atomic percent yttrium, said alloy being in the devitrified state and containing less than 40 percent intermetallic phases.

14 Claims, 5 Drawing Sheets

ALUMINUM BASE ALLOYS

BACKGROUND OF THE INVENTION

Glassy aluminum base alloys have been considered for structural applications in the aerospace industry. These alloys may involve the addition of rare earth and/or transition metal elements. Such alloys have high tensile strengths, often exceeding 200 ksi. However, disadvantageously these materials evidence little if any ductility in bulk form in the glassy state.

In an effort to impart ductility to these materials, various degrees of devitrification have been induced through heat treatment and it has been found that these materials still remain brittle. This appears to stem from the fact that these materials have a relatively high atomic percent of rare earth and/or transition metal elements for good glass formability; consequently, such alloys typically have a high volume fraction of an intermetallic phase or intermetallic phases in the devitrified state and this results in alloys that are dead brittle and useless as structural materials.

It is, therefore, a principal objective of the present invention to provide aluminum base alloys that overcome the foregoing disadvantages and are characterized by high strength and high ductility in the devitrified state.

Further objects and advantages of the present invention will appear hereinbelow.

SUMMARY OF THE INVENTION

In accordance with the present invention, it has been found that the foregoing objectives are readily obtained.

The aluminum base alloys of the present invention comprise from 3.0 to 18.5 weight percent nickel, preferably 4.0 to 18.5 weight percent nickel, from 3.0 to 14.0 weight percent yttrium, preferably 7.0 to 14.0 weight percent yttrium, balance aluminum, said alloys being in the devitrified state and containing less than 40 percent intermetallic phases. Additional alloying ingredients may be included.

In accordance with the present invention, it has now been found that the aluminum base alloys of the present invention are characterized by high strength and high ductility in the devitrified state.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
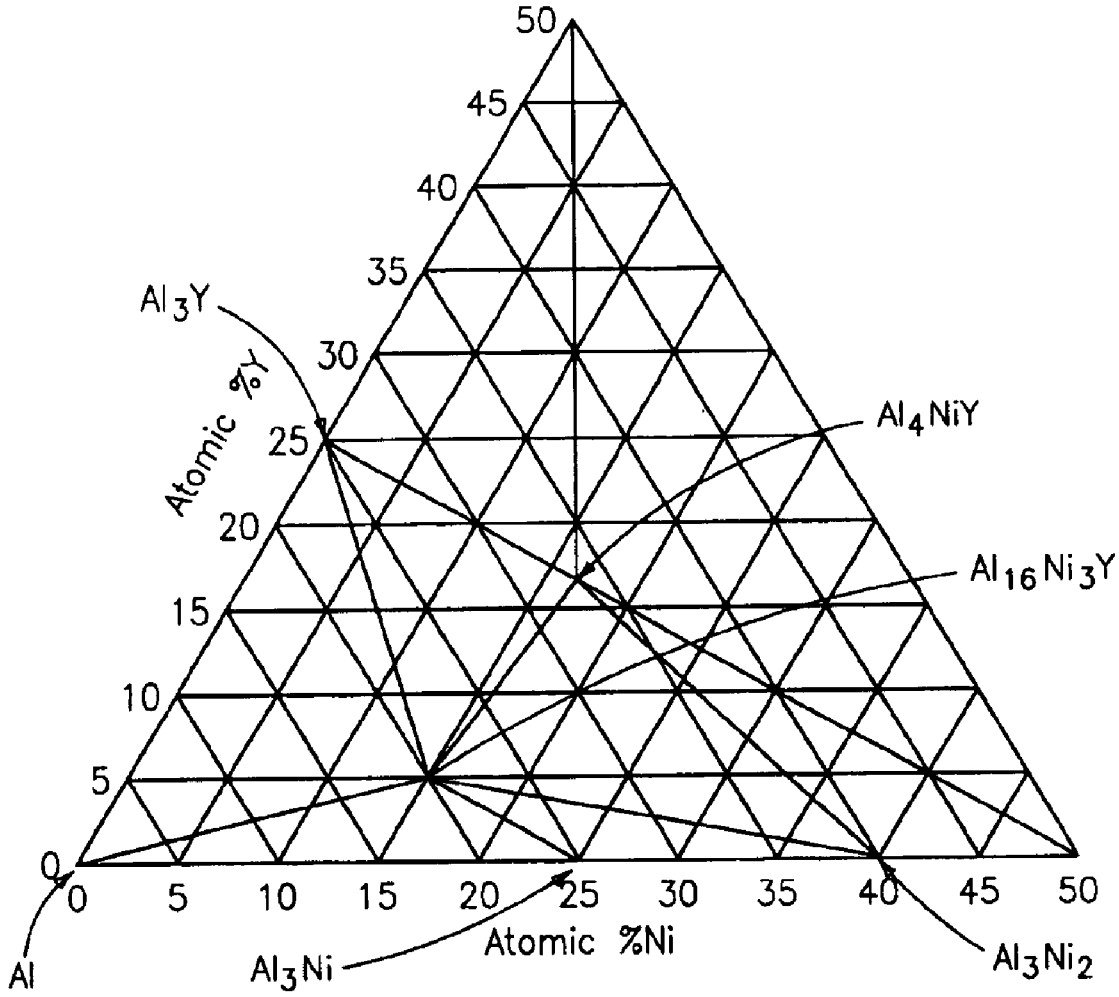
FIG. 1 is a room temperature isotherm for the Al—Y—Ni system.

A room temperature isotherm for the Al—Y—Ni system is shown in FIG. 1. Table 1, below, shows five alloy compositions of the Al—Y—Ni system, with properties thereof.

TABLE 1

| Alloy | Alloy Compositions Weight Percent | Volume Percent (v/o) of Intermetallic Phases Present: Al | $Al_3Y$ | $Al_3Ni$ | $Al_{16}Ni_3Y$ | Total v/o | Room Temperature Tensile Properties: 0.2% Yield Strength (Ksi) | Ultimate Strength (Ksi) | Elongation (%) |
|---|---|---|---|---|---|---|---|---|---|
| 1 | Al—7.2Y—17.7Ni | 41 | 0 | 4 | 55 | 59 | 91.5 | 92.2 | 2.1 |
| 2 | Al—12.3Y—17.9Ni | 26 | 7 | 0 | 67 | 74 | Brittle | Brittle | Brittle |
| 3 | Al—12.4Y—6.6Ni | 66 | 13 | 0 | 21 | 34 | 72.0 | 79.0 | 5.6 |
| 4 | Al—5.0Y—12.5Ni | 65 | 0 | 10 | 25 | 35 | 46.0 | 61.0 | 11.0 |
| 5 | Al—19.6Y—10.3Ni | 42 | 27 | 0 | 31 | 58 | Brittle | Brittle | Brittle |

Figure 2:
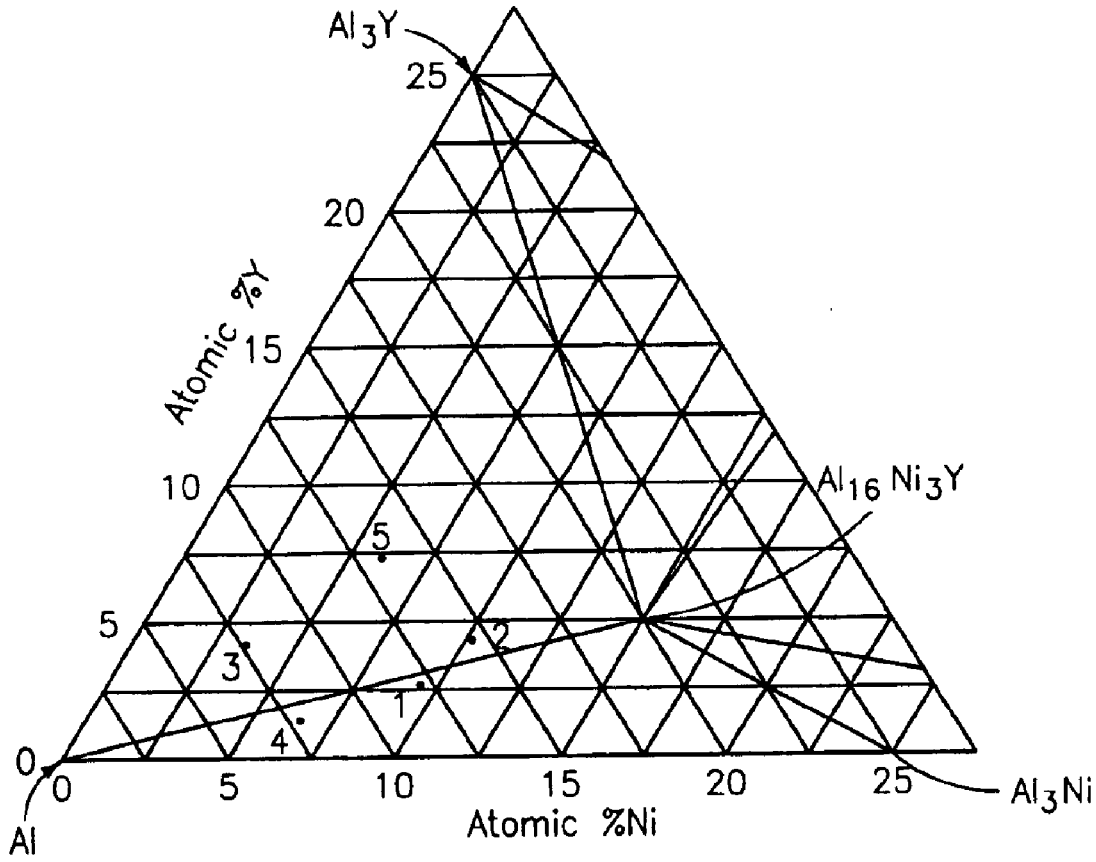
FIG. 2 is a room temperature isotherm similar to FIG. 1 showing the Al-rich end of the isotherm for the Al—Y—Ni system.

FIG. 2 shows a close up of the Al rich end of the Al—Y—Ni system shown in FIG. 1, along with the five alloy compositions prepared in accordance with Table 1.

Each of the alloys in Table 1 was devitrified. Reference to Table 1 will show that the properties of these alloys vary directly with the volume fraction of the second phase. When the volume fraction exceeds about 40% the alloys become too brittle as shown in Table 1.

Figure 3:
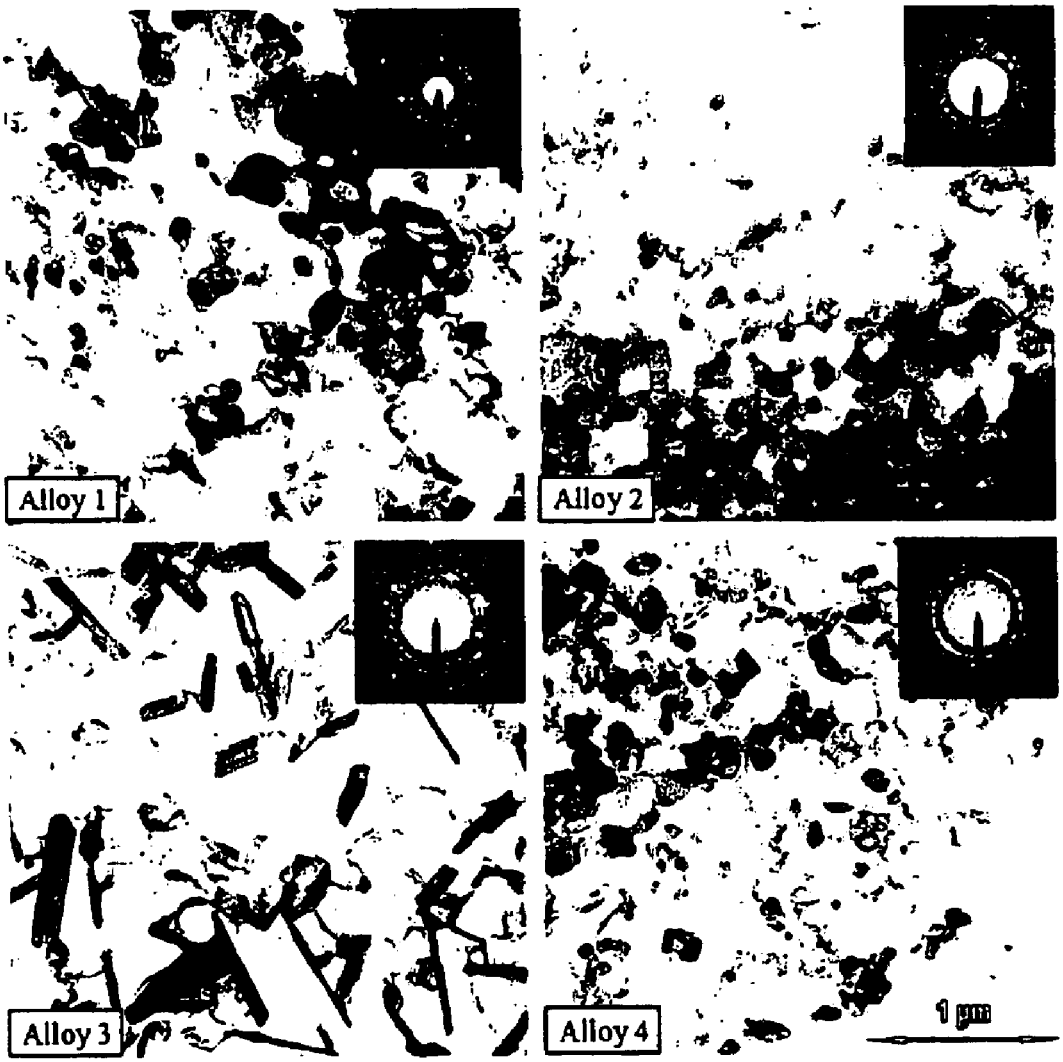
FIG. 3 represents TEM microstructures for Alloys 1–4 in the Examples.

The material with the best overall properties was Alloy 3 and it had a microstructure that is different from the other alloys as clearly shown in FIG. 3 which shows the microstructure of Alloys 1–4. As clearly shown in FIG. 3, the microstructure of the intermetallic second phase in Alloy 3 was plate-like. The plate-like morphology is beneficial for elevated temperature strength properties because of the mechanism of composite strengthening.

Figure 4:
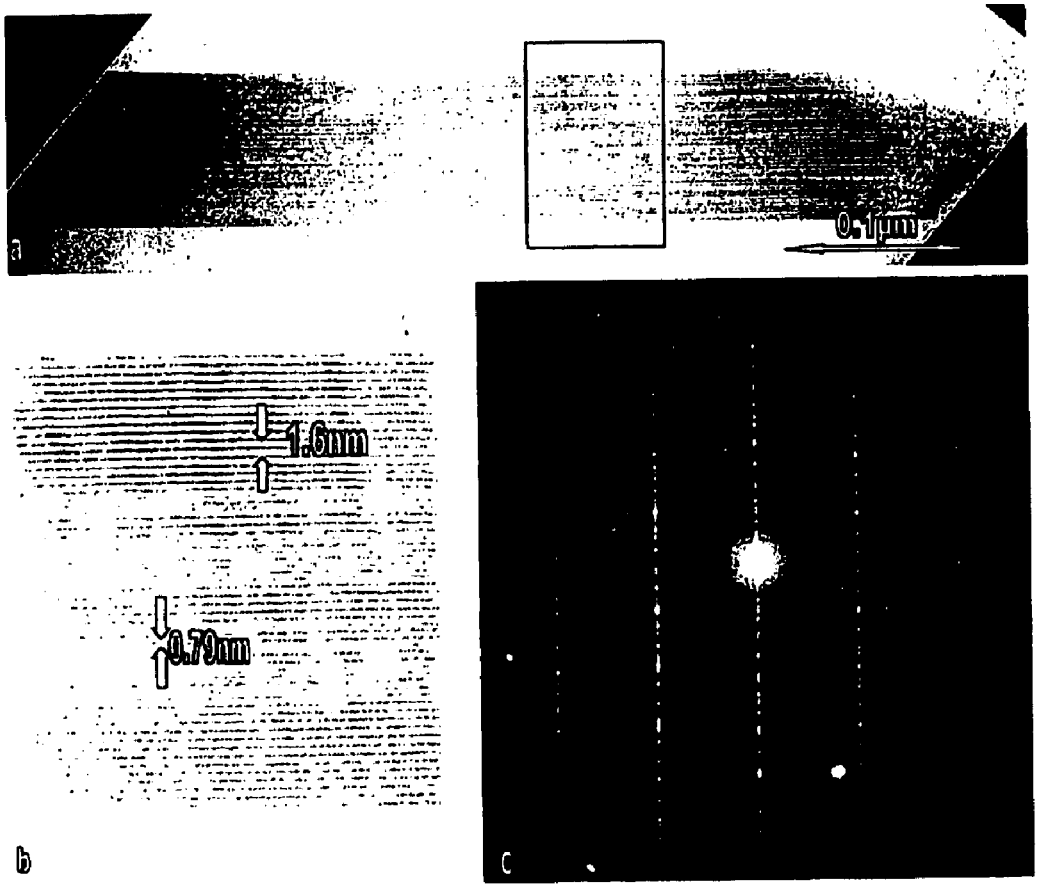
FIG. 4 is a high resolution TEM image of the side of a plate for Alloy 3 in the Examples.

High resolution TEM has shown that the plates described above for Alloy 3 seem to be composed of two phases, as shown in FIG. 4. The first phase appears to be similar to $Al_9Ni_3Y$ and forms on the inside of the plate (more solute rich), while the second phase appears to form on the outside of the plate and appear to be similar to $Al_{16}Ni_3Y$ (less solute rich).

Figure 5:
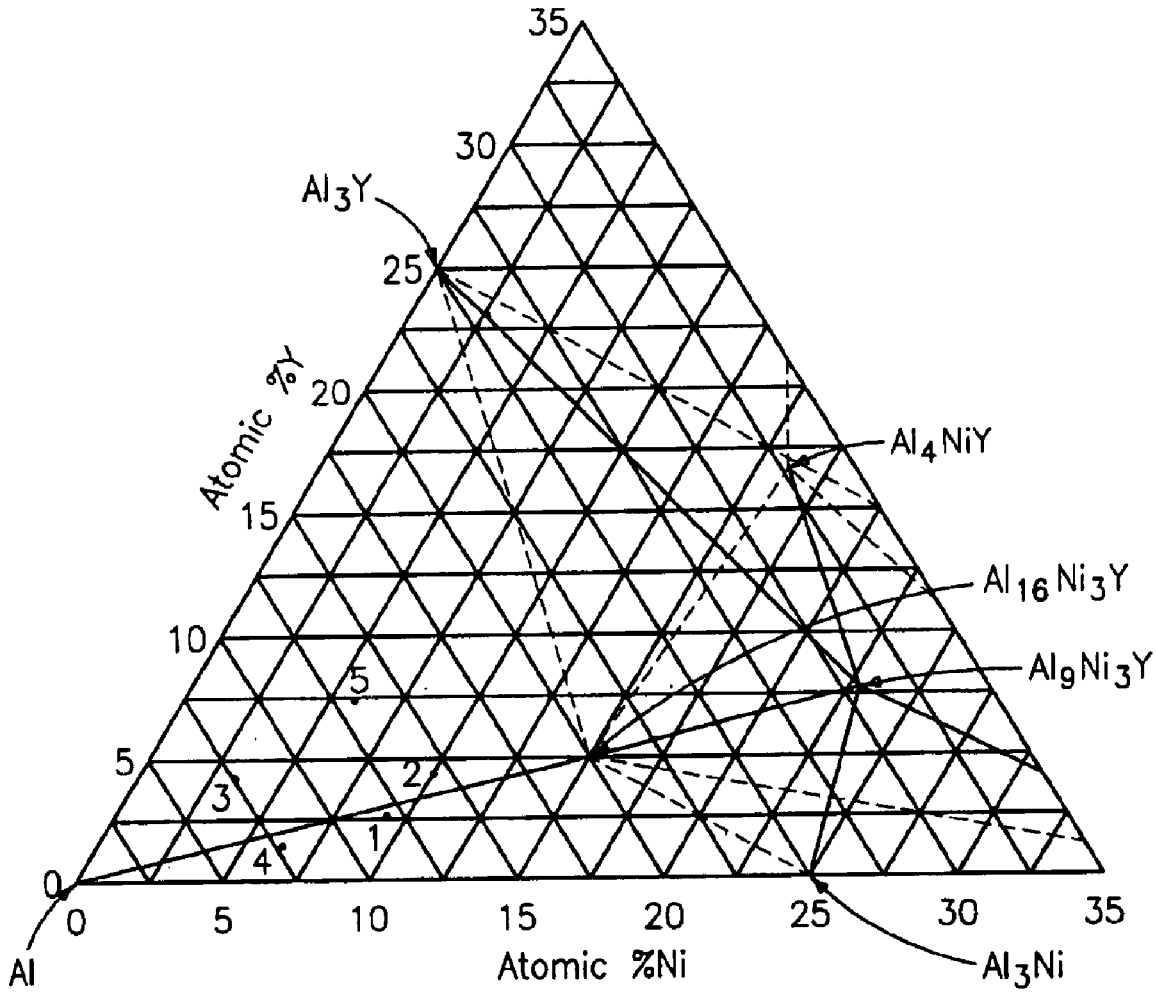
FIG. 5 is an equilibrium phase diagram for the Al—Y—Ni system.

It would appear that the $Al_9Ni_3Y$ and the $Al_{16}Ni_3Y$ are in competition thermodynamically. It would be desirable to process the glassy composition in such a way as to promote the formation of $Al_9Ni_3Y$. The significance of this can be seen in FIG. 5 where an equilibrium phase diagram for the Al—Y—Ni system is shown, having $Al_9Ni_3Y$ as the thermodynamically preferred phase. If one considers the pseudo-binary composition illustrated by the dot between Alloys 3 and 4 on FIG. 5, it becomes clear that the volume fraction of $Al_{16}Ni_3Y$ is 40%, but the volume fraction of $Al_9Ni_3Y$ is 25%. Thus, in this composition because we have enough solute to have good glass formability, but in the devitrified state we have low volume fraction of the $Al_9Ni_3Y$ phase and therefore we do not hurt our mechanical properties.

It is significant to manipulate the thermodynamics and kinetics for given compositions to allow for the formation of $Al_9Ni_eY$. This may be accomplished by the procedure outlined below.

Firstly, an alloy must be capable of forming a glassy matrix, which may or may not have α-Al present. For purposes of this discussion, it may be assumed that we are talking about a powder metallurgy process, although the present invention is not limited to a power metallurgy process. Techniques such as die casting, strip casting, etc., may be used depending on the requirements of the applications.

Secondly, in the course of processing, for example, during the outgassing and consolidation of the powder into a billet, it is desirable to process the material just above the glass transition temperature. Since the α-Al phase is the most thermodynamically favorable phase, it will nucleate and grow as very dense spheres. It has been observed that this growth continues to a point and stops. It may be that this is due to diffusion field impingement. On the other hand, Electron Energy Loss Spectroscopy (EELS) has revealed that a high concentration of the rare earth element (RE) surrounds the α-Al spheres and precludes further diffusion of Al to these spheres. This RE rich region will also be lean in Al.

As time continues to pass, the formation of a second phase local to the α-Al particles will take place. Because the region around the α-Al spheres is so solute rich, much higher than the allowable equilibrium concentration, the second phase that forms will be solute rich. Hence, in the yttrium-containing system $Al_9Ni_3Y$ forms, versus $Al_{16}Ni_3Y$. If the formation of $Al_9Ni_3Y$ is completed prior to the crystallization start time, then the glass will be depleted of solute and it will simply crystallize to α-Al. If the formation of $Al_9Ni_3Y$ is not complete prior to crystallization (devitrification), then the solute level in the glass will be lower than it was at the beginning of the formation of the $Al_9Ni_3Y$, but higher than that for α-Al, and the $Al_{16}Ni_3Y$ will nucleate heterogeneously on the $Al_9Ni_3Y$ and grow into a surrounding shell. This will deplete the transforming Al glass of rare earth, in this case yttrium, and it will crystallize into α-Al.

Once the $Al_9Ni_3Y$ phase nucleates and begins to grow, the size and shape of the phase or phases can be adjusted by the subsequent temperature at which the material is held. That is, after processing above the glass transition temperature to obtain the high density of α-Al, one can adjust the aging temperature to be either low or high, thereby controlling the second phase size and shape. That is, the lower the temperature, the finer the size, and alternatively, the higher the temperature the larger the size. The lower the temperature is the better as we have found that one obtains the plate structure shown for Alloy 3 in FIG. 3. Higher temperatures result in structures 1, 2 and 4 in FIG. 3. Hence, the composite strengthening is no longer active so that the elevated strength properties are not as good.

For the Al—Y—Ni—X system, the glassy state produces microstructures that result in superior mechanical properties when compared to those from the crystalline state. Thus, the present invention encompasses those alloy chemistries that produce a glassy material, such as glassy atomized powder (but not limited to powder), which may or may not be completely devoid of crystalline material, but having a desirable percentage of the material being glassy, that can be devitrified in either an uncontrolled or controlled manner to produce a face-centered cubic matrix of α-Al and second phases, be they metastable or equilibrium, that total less than 40% by volume. The α-Al matrix may or may not have other elements present, such as for example, magnesium, scandium, titanium, iron, zirconium, cobalt and gadolinium; however, if present, such elements could be introduced either intentionally or unintentionally to produce better glass formability, strengthening, grain or second phase refinement, or other beneficial purposes. Such a material may initially be produced using powder metallurgy methods whereby the material requires a high cooling rate, or by processes producing a lower cooling rate, such as casting processes, as roll-casting, die-casting or the float-glass process.

Typical additional elements which may be present, include one or more of the following, with percentages being in weight percent

| | | |
|---|---|---|
| magnesium | 0.1–6.5%, | preferably 1.0–6.0% |
| scandium | 0.05–5.0%, | preferably 0.1–2.0% |
| titanium | 0.1–4.0%, | preferably 0.5–3.5% |
| zirconium | 0.1–4.0%, | preferably 1.0–2.0% |
| iron | 0.1–3.5%, | preferably 1.0–2.0% |
| cobalt | 0.1–2.0%, | preferably 1.0–2.0% |
| gadolinium | 0.1–10.0%, | preferably 5.0–9.0% |

One can have the following alloying additions in a combined sum total of from 3–33 weight percent, preferably 7–14 weight percent gadolinium,
cerium,
praseodymium,
neodymium,
scandium, and/or
yttrium.

The alloying additions are beneficial to the alloy of the present invention. For example, the zirconium addition helps to make the alloy more thermally stable at elevated temperatures, the scandium addition helps to form intermetallics, which strengthen the alloy without loss of ductility, as $$Al_3Sc_xTi_{1-x},$$

$$AlSc_xTiY2r_{1-x-y}.$$

The titanium additions help to improve the thermal stability at elevated temperatures.

The alloy of the present invention advantageously may obtain yield strengths of 100 ksi–130 ksi and ductility greater than 5% and desirably greater than 10% at room temperature. Advantageously also the alloy of the present invention may obtain yield strengths of at least 25 ksi and desirably from 40–60 ksi and ductility of at least 5% and desirably greater than 10% at temperatures of at least 300° C. (575° F.).

The alloy of the present invention is also characterized by having less than 40% intermetallics, and desirably from 25–35% intermetallics. As used herein, a brittle alloy is defined as having less than 0.5 elongation, and low ductility means 0.5%<D<5%.

A preferred method of making the alloy of the present invention is discussed below.

STEP I—Gas atomization of powder. Materials are placed in a crucible and atomized to form particles which have a size sufficient to obtain a cooling rate of $10^{5-106}$ degrees C./sec. The same cooling rate may be used for degrees F./sec. This procedure is preferred for forming glassy powder. The average powder size is 75 microns or less. Atomization is desirably conducted at a pressure of at least 120–150 psi, and preferably at least 200 psi. One may use a gas content of 85He-15 Argon or other inert gas. The ideal gas content is 100% Helium.

STEP II—Vacuum hot pressing of powder into billet. The powder is poured into an aluminum container and the container is evacuated. The container is heated to a temperature of 25–30 degrees F. below the glass transition temperature, for example, for Alloys 3 and 4 in Table I, about 380° F. Pressure is applied in the range of 40 ksi–120 ksi and the billet is formed.

STEP III—Extrude billet into bar stock. The resultant billet from Step II is extruded into bar stock at a temperature of 700–900° F., preferably 750–840° F. The extrusion ratio (ratio of billet dimension or diameter to stock dimension or diameter) is greater than 10:1 for better material behavior, and preferably from 10:1 to 25:1.

The foregoing method is designed to bring out more solute rich phases, as

AlNiY,

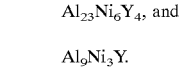
$Al_{23}Ni_6Y_4$, and

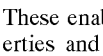
$Al_9Ni_3Y$.

These enable lower volume fractions, better ductility properties and greater glass formability. If one creates a lean structure, the ductility decreases.

Alternatively, one can employ spray forming, die casting, or said molds. The technique is desirably pre/or used within 25 to 30° F. of the glassy transition temperature.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Aluminum base alloy comprising: from 3.0 to 18.5 weight percent nickel, from 3.0 to 14.0 weight percent yttrium, balance aluminum, said alloy being in the devitrified state and containing less than 40 percent intermetallic phases, said alloy being characterized by high strength and a ductility greater than 10% at room temperature and by a plate-like microstructure of the intermetallic phases.

2. Aluminum base alloy according to claim 1, including at least one of the following with percentages in weight percent:

| | |
|---|---|
| magnesium | 0.1–6.5% |
| scandium | 0.05–5.0% |
| titanium | 0.1–4.0% |
| zirconium | 0.1–4.0% |
| iron | 0.1–3.5% |
| cobalt | 0.1–3.5% |
| gadolinium | 0.1–10.0%. |

3. Aluminum base alloy according to claim 2, including at least one of the following, with percentages in weight percent:

| | |
|---|---|
| magnesium | 1.0–6.0% |
| scandium | 0.1–2.0% |
| titanium | 0.5–3.5% |
| zirconium | 1.0–2.0% |
| iron | 1.0–2.0% |
| cobalt | 1.0–2.0% |
| gadolinium | 5.0–9.0%. |

4. Aluminum base alloy according to claim 1, including at least one of the following alloying additions in a combined sum total of from 3 to 33 weight percent:

gadolinium, cerium, praseodymium, neodymium, scandium, and yttrium.

5. Aluminum base alloy according to claim 4, wherein the sum total of said alloying additions is from 7–14 weight percent.

6. Aluminum base alloy according to claim 1, wherein said intermetallic phases include at least one of the following:

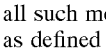
$Al_3Y$,

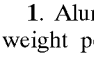
$Al_3Ni$,

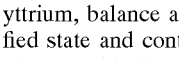
$Al_{16}Ni_3Y$,

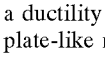
$A_9Ni_3Y$.

7. Aluminum base alloy according to claim 1, wherein said alloy includes a glassy matrix that can be devitrified to produce a face-centered cubic matrix of α-Al.

8. Aluminum base alloy consisting of: from 3.0 to 18.5 weight percent nickel, from 3.0 to 14.0 weight percent yttrium, balance aluminum, said alloy being in the devitrified state and containing less than 40 percent intermetallic phases, and said alloy having a ductility greater than 10% at room temperature.

9. Aluminum base alloy according to claim 8, wherein the microstructure of at least one intermetallic phase is plate-like.

10. Aluminum base alloy according to claim 8, having a yield strength greater than 100 ksi.

11. Aluminum base alloy according to claim 8, having a yield strength of at least 25 ksi and a ductility greater than 5% at temperatures of at least 300° C.

12. Aluminum base alloy consisting of: from 3.0 to 18.5 weight percent nickel, from 3.0 to 14.0 weight percent yttrium, at least one addition selected from the group consisting of from 0.1 to 6.5 weight percent magnesium, from 0.05 to 5.0 weight percent scandium, from 0.1 to 4.0 weight percent titanium, from 0.1 to 4.0 wt % zirconium, from 0.1 to 3.5 weight percent iron, from 0.1 to 3.5 weight percent cobalt, and from 0.1 to 10 weight percent gadolinium, and the balance aluminum, said alloy being in the devitrified state and containing less than 40 percent intermetallic phases, and having a ductility greater than 10% at room temperature.

13. Aluminum base alloy consisting of: from 3.0 to 18.5 weight percent nickel, from 3.0 to 14.0 weight percent yttrium, at least one alloying addition selected from the group consisting of gadolinium, cerium, praseodymium, neodymium, and scandium in a combined sum total of from 3.0 to 33 weight percent, and the balance aluminum, said alloy being in the devitrified state and containing less than 40 percent intermetallic phases, and having a ductility greater than 10% at room temperature.

14. Aluminum base alloy consisting of: from 3.0 to 18.5 weight percent nickel, from 3.0 to 14.0 weight percent yttrium, at least one addition selected from the group consisting of from 0.1 to 6.5 weight percent magnesium, from 0.05 to 5.0 weight percent scandium, from 0.1 to 4.0 weight percent titanium, from 0.1 to 4.0 wt % zirconium, from 0.1 to 3.5 weight percent iron, from 0.1 to 3.5 weight percent cobalt, and from 0.1 to 10 weight percent gadolinium, at least one alloying addition selected from the group consisting of gadolinium, cerium, praseodymium, neodymium, and scandium in a combined sum total of from 3.0 to 33 weight percent, and the balance aluminum, said alloy being in the devitrified state and containing less than 40 percent intermetallic phases, and having a ductility greater than 10% at room temperature.

* * * * *